US010501863B2

(12) United States Patent
Otake

(10) Patent No.: US 10,501,863 B2
(45) Date of Patent: Dec. 10, 2019

(54) FORMING METHOD AND FORMED ARTICLE

(71) Applicant: SEIKO EPSON CORPORATION, Tokyo (JP)

(72) Inventor: Toshihiro Otake, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 295 days.

(21) Appl. No.: 14/831,479

(22) Filed: Aug. 20, 2015

(65) Prior Publication Data

US 2016/0053399 A1 Feb. 25, 2016

(30) Foreign Application Priority Data

Aug. 25, 2014 (JP) ..... 2014-170174

(51) Int. Cl.

| | |
|---|---|
| ***C25F 3/00*** | (2006.01) |
| ***C25F 5/00*** | (2006.01) |
| ***C25F 3/14*** | (2006.01) |
| ***B22F 3/24*** | (2006.01) |

(52) U.S. Cl.

CPC ..... *C25F 3/14* (2013.01); *B22F 3/24* (2013.01); *C25F 3/00* (2013.01); *C25F 5/00* (2013.01); *B22F 2003/245* (2013.01); *B22F 2003/247* (2013.01); *B22F 2998/10* (2013.01)

(58) Field of Classification Search

CPC ..... C25F 3/00; C25F 3/02; C25F 3/14; C25F 5/00; G12B 9/08

See application file for complete search history.

(56) References Cited

U.S. PATENT DOCUMENTS

| | | | | |
|---|---|---|---|---|
| 3,905,883 | A * | 9/1975 | Hanazono | C25F 3/14 205/666 |
| 4,135,989 | A * | 1/1979 | Pruett | C25F 3/14 205/660 |
| 5,567,300 | A * | 10/1996 | Datta | B23H 3/08 204/224 M |
| 7,004,798 | B2 * | 2/2006 | Yuasa | H01R 4/62 439/874 |
| 9,045,842 | B2 * | 6/2015 | Han | C25F 5/00 |
| 2005/0139488 | A1 * | 6/2005 | Ogihara | C25F 5/00 205/721 |
| 2011/0033725 | A1 | 2/2011 | Archer | |
| 2011/0155201 | A1 * | 6/2011 | Abagnale | H01L 35/30 126/212 |

(Continued)

FOREIGN PATENT DOCUMENTS

| | | | | |
|---|---|---|---|---|
| CN | 201332205 Y | * | 10/2009 | H01R 41/00 |
| CN | 202337839 U | * | 7/2012 | C25C 5/02 |

(Continued)

OTHER PUBLICATIONS

CN 201332205 (Oct. 21, 2009); machine translation.*

Min et al. (CN 202337839) Jul. 18, 2012; machine translation. (Year: 2012).*

*Primary Examiner* — Rip A Lee

(74) *Attorney, Agent, or Firm* — Workman Nydegger

(57) ABSTRACT

A forming method includes: forming a formed article including a first part and a second part using a first metal for the first part and a second metal for the second part; and removing the second part from the formed article by immersing the formed article in an electrolyte solution and causing a current to flow in the second part.

6 Claims, 4 Drawing Sheets

(56) References Cited

U.S. PATENT DOCUMENTS

| | | | | |
|---|---|---|---|---|
| 2011/0168091 | A1 | 7/2011 | Baumann et al. | |
| 2012/0273261 | A1* | 11/2012 | Yi | C23C 18/1653 174/255 |
| 2016/0024676 | A1* | 1/2016 | Willigan | C25D 3/665 428/609 |
| 2016/0040312 | A1* | 2/2016 | Chen | C25D 3/665 428/654 |

FOREIGN PATENT DOCUMENTS

| | | | | | |
|---|---|---|---|---|---|
| CN | 203351775 | U | * | 12/2013 | H01R 11/01 |
| JP | 50-017341 | A | | 2/1975 | |
| JP | 59113626 | A | * | 6/1984 | B24B 37/013 |
| JP | 10-195676 | A | | 7/1998 | |
| JP | 2003-320595 | A | | 11/2003 | |
| JP | 2004-255839 | A | | 9/2004 | |
| JP | 2011-020412 | A | | 2/2011 | |
| JP | 2013-067119 | A | | 4/2013 | |
| JP | 2013-224043 | A | | 10/2013 | |

* cited by examiner

FORMING METHOD AND FORMED ARTICLE

CROSS-REFERENCE TO RELATED APPLICATIONS

This application claims priority to Japanese Patent Application No. 2014-170174 filed on Aug. 25, 2014. The entire disclosures of Japanese Patent Application No. 2014-170174 is hereby incorporated herein by reference.

BACKGROUND

1. Technical Field

The present invention relates to a forming method and a formed article.

2. Related Art

When a three-dimensional object having a shape with a hollow space, an eaves-like shape, or the like is formed with metal, a casting method using a mold and a method of removing an unnecessarily part from a rectangular parallelepiped block by machining such as cutting or the like have been used in the related art. In the casting method, mold production is required and finish processing after casting is also required. Thus, a problem arises in that plural molds are required when the three-dimensional object has a shape with a hollow space. In the machining method, considerable man-hours are required for cutting. Accordingly, in these methods, there is a problem of requiring many man-hours and costs for forming.

In JP-A-2003-320595, there is disclosed a method of forming a three-dimensional object by three-dimensional forming in which processes of disposing a metal powder layer, sintering a portion of the metal powder layer, which becomes a main body portion (core for manufacturing a tire), by irradiation with laser light, disposing a metal powder layer on the sintered layer in a laminated manner, and sintering the layers are repeatedly performed. In the technique disclosed in JP-A-2003-320595, it is possible to obtain a three-dimensional object (core for manufacturing a tire) including a main body portion by sintering the entire main body portion and then removing metal powder which is not sintered in portions other than the main body portion (support portion) with few man-hours compared to the related art.

However, in the technique disclosed in JP-A-2003-320595, in the process of forming a three-dimensional object, the metal powder layer in a powder state is laminated in the portions other than the main body portion (support portion) to be sintered. Therefore, since the support portion does not have the same strength as the main body portion, the support portion cannot be handled in the same manner as the main body portion. For example, when a part of the support portion is caused to collapse (move) by vibration, impact or the like, there is a concern that the shape of the main body portion to be formed on the support portion may not be a desired shape. In addition, when the metal powder of the support portion after the entire main body portion is sintered is removed, for example, there is a concern that some of the metal powder of the support portion may adhere (remain) onto the surface of the main body portion by static electricity or the like. Accordingly, a forming method, which is simpler than the casting method and the machining method and is capable of more easily and accurately forming a three-dimensional object and more reliably removing the support portion, has been demanded.

SUMMARY

An advantage of some aspects of the invention is to solve at least a part of the problems described above, and the invention can be implemented as the following forms or application examples.

Application Example 1

This application example is directed to a forming method including forming a formed article including a first part and a second part using a first metal for the first part and a second metal for the second part, and removing the second part from the formed article by immersing the formed article in an electrolyte solution and causing a current to flow in the second part.

In the forming method according to this application example, since the formed article including the first part and the second part is formed using the first metal and the second metal, for example, a formed article having a shape with a hollow space, an eaves-like shape, or the like can be easily formed by forming the first part into a main body portion and forming the second part into a support portion. The second metal is oxidized and ionized by immersing the formed article in an electrolyte solution and causing a current to flow in the second part and thus the second part can be removed. Thus, a three-dimensional object can be easily formed without requiring a mold and machining unlike in the related art.

Application Example 2

In the forming method according to the application example described above, it is preferable that, in the forming of the formed article, the first metal and the second metal are sintered.

In the forming method according to this application example, since in the forming of the formed article, the first metal and the second metal are sintered, the second part (support portion) has the same strength as the first part (main body portion) and the second part can be handled in the same manner as the first part. Thus, a three-dimensional object can be more easily and accurately formed. In addition, since in the removing of the second part, the sintered second metal is ionized and removed, the second part can be easily removed and some of the second metal can be prevented from remaining on the surface of the first part.

Application Example 3

In the forming method according to the application example described above, it is preferable that an oxidation potential of the second metal is lower than an oxidation potential of the first metal.

In the forming method according to this application example, since the oxidation potential of the second metal is lower than the oxidation potential of the first metal, the second metal can be oxidized without oxidation of the first metal by setting of the potential to be applied in the removing of the second part. Accordingly, the second part can be selectively removed by ionizing the second metal.

Application Example 4

In the forming method according to the application example described above, it is preferable that, in the removing of the second part, a potential which is equal to or higher than the oxidation potential of the second metal and lower than the oxidation potential of the first metal is applied to the formed article.

In the forming method according to this application example, since in the removing of the second part, the potential which is equal to or higher than the oxidation potential of the second metal and lower than the oxidation potential of the first metal is applied to the formed article, the second metal can be ionized without oxidation of the first metal. Accordingly, the second part can be easily and reliably removed while the first part remains.

Application Example 5

This application example is directed to a formed article, which is formed using a first metal for a first part and a second metal for a second part, AND including the first part and the second part, in which an oxidation potential of the second metal is lower than an oxidation potential of the first metal.

In the configuration according to this application example, since the formed article is formed using the first metal for the first part and the second metal for the second part, for example, a formed article having a shape with a hollow space, an eaves-like shape, or the like can be easily formed by forming the first part into a main body portion and forming the second part into a support portion. The second metal is oxidized and ionized by immersing the formed article in an electrolyte solution and causing a current to flow in the second part, and thus the second part can be easily removed. Therefore, a three-dimensional object can be easily formed without requiring a mold and machining unlike in the related art.

Application Example 6

This application example is directed to a formed article, which is obtained by forming an article using a first metal for a first part and a second metal for a second part and then removing the second part, in which an oxidation potential of the second metal is lower than an oxidation potential of the first metal.

According to this configuration of the application example, since the formed article is formed using the first metal for the first part and the second metal for the second part and then the second part is removed, for example, a formed article having a shape with a hollow space, an eaves-like shape, or the like can be easily formed by forming the first part into a main body portion and forming the second part into a support portion. The second metal is oxidized and ionized by immersing the formed article in an electrolyte solution and causing a current to flow in the second part, and thus the second part can be easily removed. Therefore, a three-dimensional object can be easily formed without requiring a mold and machining unlike in the related art.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is embodied will be described with reference to drawings.

Formed Article

Figure 1:
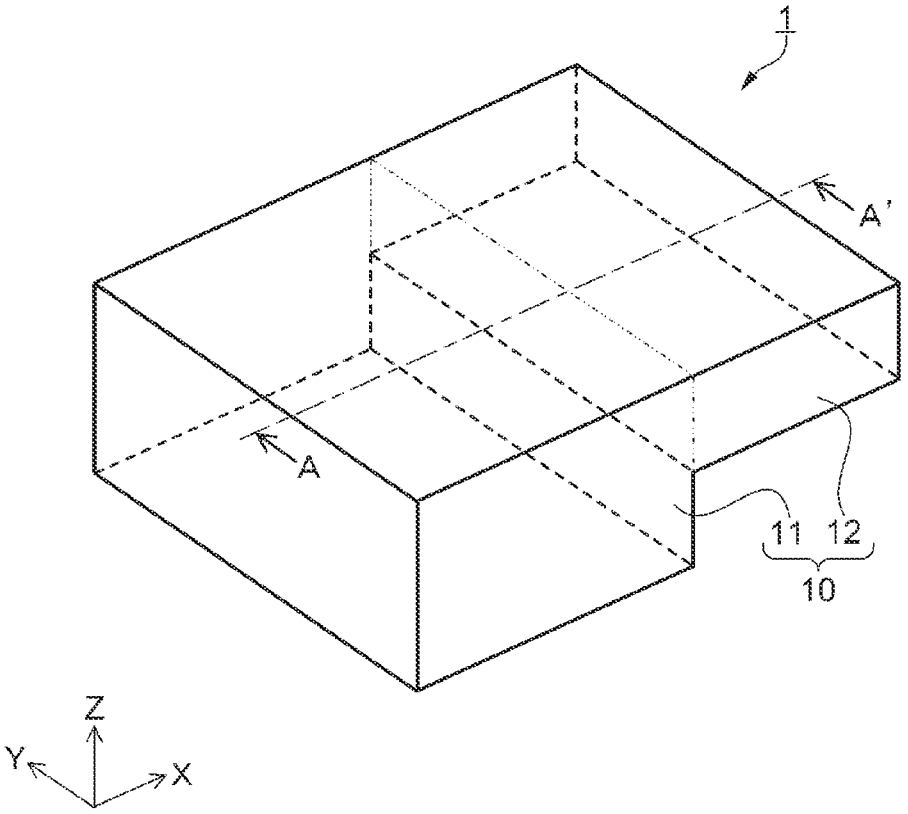
FIG. 1 is a perspective view illustrating a three-dimensional object as a formed article according to an embodiment.

First, a three-dimensional object as a formed article according to an embodiment will be described with reference to FIG. 1. FIG. 1 is a perspective view illustrating a three-dimensional object as a formed article according to an embodiment. As illustrated in FIG. 1, a three-dimensional object 1 according to the embodiment includes a main body portion 10 as a first part. The main body portion 10 has a substrate 11 and an eaves portion 12. The main body portion 10 (the surface on the upper side illustrated in FIG. 1) has a substantially rectangular upper surface and has a region ranging from the substrate 11 to the eaves portion 12. The main body portion 10 is made of metal (first metal).

A direction along the long side of the upper surface of the main body portion 10 is set to an X direction and a direction crossing the X direction along the short side of the upper surface is set to a Y direction. A direction which is the thickness direction of the main body portion 10 and crosses the X direction and the Y direction is set to a Z direction. The main body portion 10 has a shape in which the eaves portion 12 extends from the upper direction of the substrate 11 (+Z direction) to the +X direction. The main body portion 10 can be formed to have a shape in which the lower portion of the eaves portion 12 (−Z direction) is removed from a rectangular parallelepiped body having a bottom surface with the same size as the size of the upper surface.

Forming Method

The three-dimensional object 1 (main body portion 10) according to the embodiment is formed by three-dimensional forming. More specifically, based on three-dimensional data of the final shape of the three-dimensional object 1 which is designed using three-dimensional CAD or the like as illustrated in FIG. 1, data is created in which the three-dimensional object 1 is divided into thin plates having planes defined by the X direction and the Y direction. Then, each layer of the thin plate-like layers is formed using a 3D printer or dispenser and laminated in the +Z direction so as to form the three-dimensional object 1.

On the lower side of three-dimensional object 1 (main body portion 10) (−Z direction) illustrated in FIG. 1, only the substrate 11 is present. However, the substrate 11 and the eaves portion 12 are present on the upper side (+Z direction). In other words, the substrate 11 is a part to be grounded and the eaves portion 12 is a part to be floating in the space. Therefore, when the three-dimensional object 1 is formed by laminating the thin plate-like layers having planes defined by the X direction and the Y direction, a member which supports the lower side of the eaves portion 12 is required.

In the embodiment, when the three-dimensional object 1 is formed, as a member which supports the eaves portion 12 of the main body portion 10, a support portion 20 (refer to FIG. 2E) as a second part is formed together with the main body portion 10. The main body portion 10 is formed and then the support portion 20 is removed. Accordingly, the data in which the above-described three-dimensional object 1 is divided into thin plates includes the main body portion 10 and the support portion 20. The support portion 20 is made of metal (second metal).

The metal for the main body portion 10 (first metal) and the metal for the support portion 20 (second metal) are selected so as to have a combination in which the oxidation potential of the metal for the support portion 20 is lower than the oxidation potential of the metal for the main body portion 10. For example, different combinations of cases of using silver (Ag) as the metal for the main body portion 10 and copper (Cu) as the metal for the support portion 20, using copper (Cu) as the metal for the main body portion 10 and tin (Sn) as the metal for the support portion 20, using tin (Sn) as the metal for the main body portion 10 and zinc (Zn) as the metal for the support portion 20, and the like can be used.

Figure 2A:
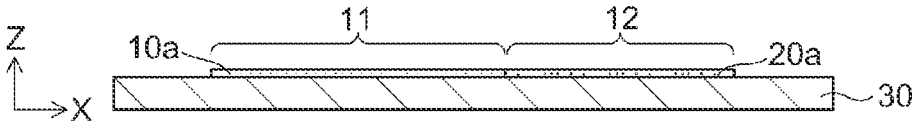
FIGS. 2A to 2F are sectional views illustrating a method of forming the three-dimensional object according to the embodiment.

Hereinafter, the forming method according to the embodiment will be described with reference to FIGS. 2A to 3. FIGS. 2A to 2F are sectional views illustrating a method of forming the three-dimensional object according to the embodiment. FIGS. 2A to 2F correspond to sectional views taken along a line A-A' in FIG. 1. FIG. 3 is a view illustrating a method of removing a support portion according to the embodiment.

As illustrated in FIG. 2A, the material of the metal for the main body portion 10 is disposed in a region in which the substrate 11 is provided on a substrate 30 as a main body portion metal material layer 10*a* corresponding to the data in which the main body portion 10 is divided into thin plates. In addition, the material of the metal for the support portion 20 is disposed in a region which overlaps with a region in which the eaves portion 12 is provided on the substrate 30 as seen from a plan view, as a support portion metal material layer 20*a* corresponding to the data in which the support portion 20 is divided into thin plates.

As the material of the metal for the main body portion 10 and the material of the metal for the support portion 20, for example, powdered metal, a metal powder paste using a binder, and the like are used. As the material of the metal for the main body portion 10 and the material of the metal for the support portion 20, a wire-shaped material or a tape-shaped material may be used. The substrate 30 is provided for supporting the main body portion 10 (main body portion metal material layer 10*a*) and the support portion 20 (support portion metal material layer 20*a*) in the process of forming the three-dimensional object 1.

Figure 2B:
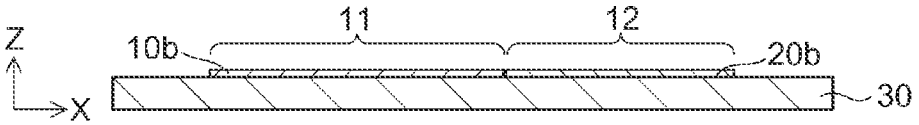
Figure 3:
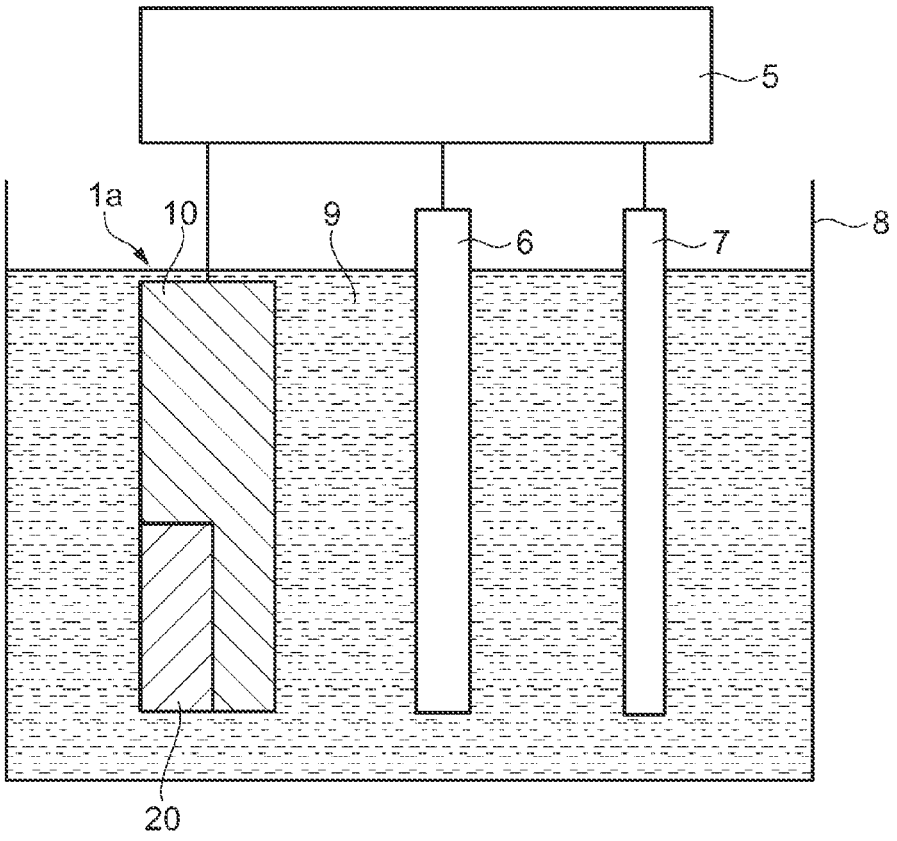
FIG. 3 is a view illustrating a method of removing a support portion according to the embodiment.

Next, as illustrated in FIG. 2B, for example, the main body portion metal material layer 10*a* and the support portion metal material layer 20*a* are sintered by irradiation with laser light to form a thin plate-like main body portion metal material layer 10*b* and a support portion metal layer 20*b*. Next, although not illustrated in the drawing, the main body portion metal material layer 10*a* and the support portion metal material layer 20*a* illustrated in FIG. 2A are disposed on the thin plate-like main body portion metal material layer 10*b* and the support portion metal layer 20*b* and sintered to form a thin plate-like main body portion metal material layer 10*b* and a support portion metal layer 20*b*.

Figure 2C:
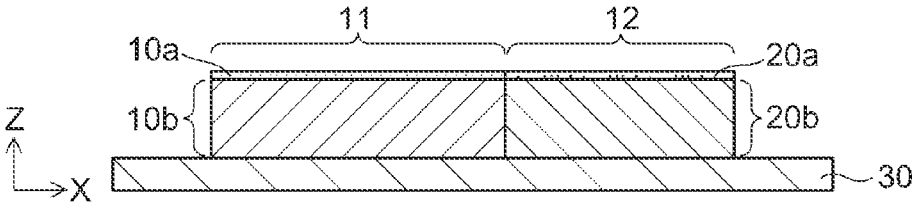

As illustrated in FIG. 2C, a process of disposing and sintering the above-described main body portion metal material layer 10*a* and the support portion metal material layer 20*a* is repeatedly performed and thus the thin plate-like main body portion metal layer 10*b* and the support portion metal layer 20*b* are respectively and sequentially laminated and integrated. Further, the main body portion metal material layer 10*a* and the support portion metal material layer 20*a* are disposed thereon and sintered. In the layers including only the substrate 11 without the eaves portion 12 in the main body portion 10 to be formed, the main body portion metal layer 10*b* is laminated in the region in which the substrate 11 is provided and the support portion metal layer 20*b* is laminated in a region overlapping with the region in which the eaves portion 12 is provided as seen from a plan view.

Since both the main body portion metal material layer 10*a* and the support portion metal material layer 20*a* are sintered as described above in a process of forming a rectangular parallelepiped body 1*a*, the support portion metal layer 20*b* has the same strength as the main body portion metal layer 10*b*. Thus, the rectangular parallelepiped body 1*a* can be more easily and accurately formed.

Figure 2D:
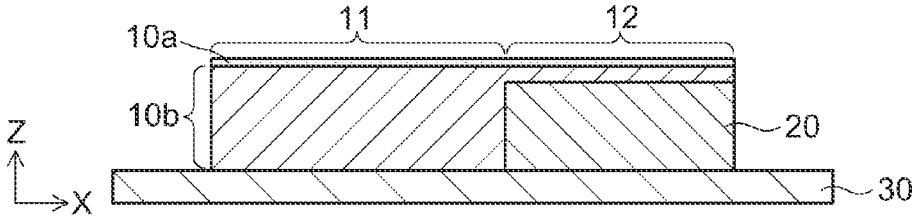

As illustrated in FIG. 2D, in the layers including the substrate 11 and the eaves portion 12 in the main body portion 10 to be formed, only the main body portion metal material layer 10*a* is disposed in the region in which the substrate 11 is provided and the region in which the eaves portion 12 is provided and sintered and the main body portion metal layer 10*b* is laminated.

Figure 2E:
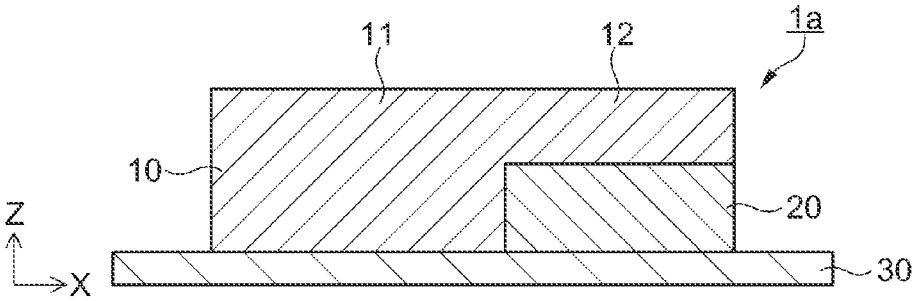

As illustrated in FIG. 2E, the rectangular parallelepiped body 1*a* including the main body portion 10 and the support portion 20 is formed by laminating the main body portion metal layer 10*b* up to the uppermost layer. In the rectangular parallelepiped body 1*a*, the support portion 20 is positioned between the eaves portion 12 and the substrate 30 so as to support the eaves portion 12.

Next, the rectangular parallelepiped body 1*a* is detached from the substrate 30 and then the support portion 20 is removed from the rectangular parallelepiped body 1*a*. In the process of removing the support portion 20 from the rectangular parallelepiped body 1*a*, for example, a potentiostat 5 illustrated in FIG. 3 is used. As illustrated in FIG. 3, the rectangular parallelepiped body 1*a* (working electrode), a counter electrode 6 and a reference electrode 7 are connected to the potentiostat 5. The rectangular parallelepiped body 1*a*, the counter electrode 6 and the reference electrode 7 are immersed in an electrolyte solution 9 stored in a solution layer 8.

By using the potentiostat 5, a predetermined potential with a constant value is applied to the rectangular parallelepiped body 1*a* using the reference electrode 7 as a reference. As described above, the oxidation potential of the metal for the support portion 20 (second metal) is lower than the oxidation potential of the metal for the main body portion 10 (first metal). As the predetermined potential, a potential which is equal to or higher than the oxidation potential of the metal for the support portion 20 and lower than the oxidation potential of the metal for the main body portion 10 is applied to oxidize only the metal for the support portion 20. Such a predetermined potential is set as follows according to the combinations of the above-described respective metals.

When the predetermined potential is set to Va, in the case in which the metal for the main body portion 10 (first metal) is silver (Ag) and the metal for the support portion 20 (second metal) is copper (Cu), the oxidation potential of silver is +0.800 V and the oxidation potential of copper is +0.342 V. Thus, the predetermined potential Va is +0.342 Va<+0.800. In the case in which the metal for the main body portion 10 is copper (Cu) and the metal for the support portion 20 is tin (Sn), the oxidation potential of tin is −0.138 V and thus the predetermined potential Va is −0.138 Va<+0.342. In the case in which the metal for the main body portion 10 is tin (Sn) and the metal for the support portion 20 is zinc (Zn), the oxidation potential of zinc is −0.762 V and thus the predetermined potential Va is −0.762 Va<−0.138.

Figure 2F:
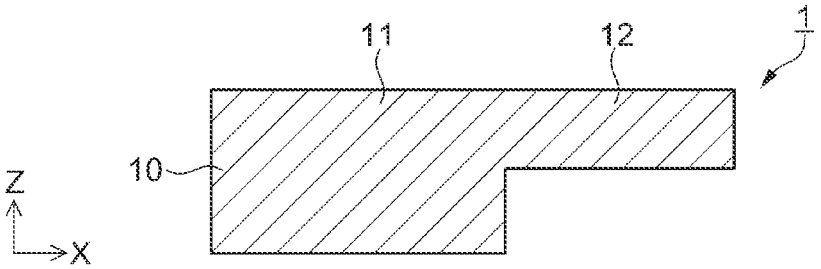

By applying the predetermined potential to the rectangular parallelepiped body 1*a*, a current flows between the rectangular parallelepiped body 1*a* and the counter electrode 6, that is, between the support portion 20 and the counter electrode 6. When a current flows therebetween, the potential which is equal to or higher than the oxidation potential of the second metal is applied to the support portion 20. Thus, the second metal is oxidized and ionized. Accordingly, the support portion 20 made of the second metal is dissolved in the electrolyte solution 9 from the surface which is in contact with the electrolyte solution 9. Since the metal for the main body portion 10 is not oxidized, the entire support portion 20 is dissolved and the support portion 20 is removed from the rectangular parallelepiped body 1*a* and only the main body portion 10 is present. As a result, as illustrated in FIG. 2F, the three-dimensional object 1 including only the main body portion 10 is obtained.

According to the forming method of the embodiment, the rectangular parallelepiped body 1*a* including the main body portion 10 and the support portion 20 is formed using the first metal and the second metal and the support portion 20 is removed from the rectangular parallelepiped body 1*a* in a process of removing the support portion 20. In the process of removing the support portion 20, the metal for the support portion 20 (second metal) is selectively oxidized, dissolved in the electrolyte solution 9, and removed by itself. Thus, it is possible to easily remove the support portion 20. Therefore, the three-dimensional object 1 can be more easily formed compared to the related art which requires a mold and machining.

Further, in a process of forming the rectangular parallelepiped body 1*a*, the powdered metal for the main body portion 10 (first metal) and the metal for the support portion 20 (second metal) are also sintered. Thus, the support portion 20 has the same strength as the main body portion 10 and the support portion 20 can be handled in the same manner as the main body portion 10. Accordingly, compared to the case in which the main body portion 10 is formed when the metal for the support portion 20 is in a powder state, the rectangular parallelepiped body 1*a* can be more easily and accurately formed. In the process of removing the support portion 20, since the sintered second metal is oxidized and ionized, and the support portion is removed, some of the metal for the support portion 20 (second metal) can be prevented from remaining on the surface of the three-dimensional object 1 (main body portion 10).

A three-dimensional object which can be formed by the forming method according to the embodiment is not limited to the three-dimensional object 1 illustrated in FIG. 1. According to the forming method of the embodiment, for example, a three-dimensional object having a shape with a hollow space, a three-dimensional object having a complicated inner shape, and three-dimensional objects having other shapes can be formed.

The above-described embodiment is merely an aspect of the invention and may be arbitrarily modified and applied within the range of the invention. As a modification example, for example, the following example can be considered.

Modification Example

In the above-described embodiment, the rectangular parallelepiped body 1*a* including the main body portion 10 and the support portion 20 is formed by repeatedly performing the process of disposing and sintering the metal for the main body portion 10 (first metal) and the metal for the support portion 20 (second metal). However, the invention is not limited to the embodiment. A configuration in which an alloy layer is formed at the interface between the main body portion 10 and the support portion 20 by repeatedly performing the process may be adopted. In addition, the alloy layer may remain in the finally obtained three-dimensional object.

Also in a modification example, similar to the processes of the embodiment shown in FIGS. 2A to 2D, the process of disposing and sintering the metal for the main body portion 10 (first metal) and the metal for the support portion 20 (second metal) is repeatedly performed. When such a process is repeatedly performed, an alloy of the first metal and the second metal is formed at a portion in which the main body portion 10 is in contact with the support portion 20 by the combination of the first metal and the second metal in some cases.

Figure 4A:
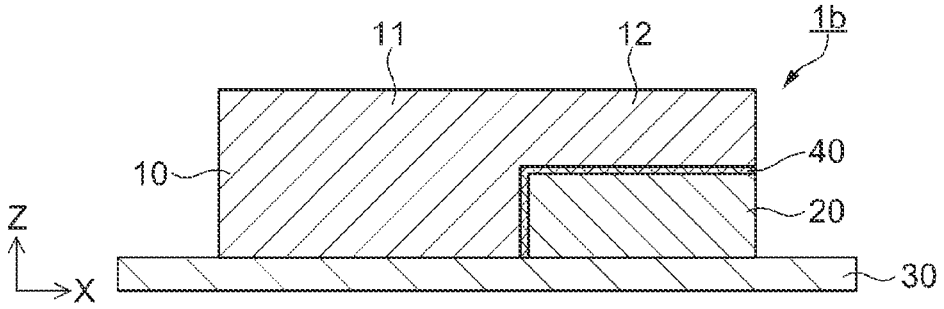
FIGS. 4A and 4B are sectional views illustrating a forming method according to a modification example.
Figure 4B:
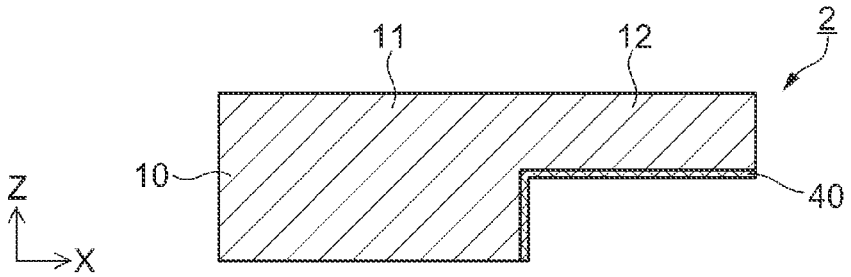

FIGS. 4A and 4B are sectional views illustrating a forming method according to a modification example. FIG. 4A is a view corresponding to FIG. 2E in the above-described embodiment. As illustrated in FIG. 4A, a rectangular parallelepiped body 1*b* includes the main body portion 10 and the support portion 20. However, an alloy layer 40 of the first metal and the second metal is formed at the interface between the main body portion 10 and the support portion 20. When the alloy layer 40 is present at the interface between the main body portion 10 and the support portion 20 in the rectangular parallelepiped body 1*b*, stress generated between the main body portion 10 and the support portion 20 due to the fact that the thermal expansion coefficient of the first metal is different from the thermal expansion coefficient of the second metal can be alleviated because the alloy layer 40 functions as a buffering member. Accordingly, in the process of forming the rectangular parallelepiped body 1*b*, warpage or deformation generated due to the difference in thermal expansion coefficient between the first metal and the second metal can be suppressed.

FIG. 4B is a view corresponding to FIG. 2F in the above-embodiment. When the alloy layer 40 is formed in the rectangular parallelepiped body 1*b* as illustrated in FIG. 4A, the alloy layer 40 may remain in a three-dimensional object 2 which is finally obtained as illustrated in FIG. 4B. In addition, even when the alloy layer 40 is formed in the rectangular parallelepiped body 1*b*, the alloy layer 40 may not remain in the three-dimensional object 1 which is finally obtained as illustrated in FIG. 2F. Whether or not the alloy layer 40 finally remains can be determined by, for example, controlling the setting of the potential to be applied to the rectangular parallelepiped body 1*b*, the length of potential application time, and the like in the process of removing the support portion 20.

What is claimed is:

1. A method for forming an article, the method comprising:

forming a first part of the article to include a substrate portion and an eaves portion by depositing a plurality of layers in a stacked arrangement, the first part comprising a first metal;

forming a second part of the article by depositing a plurality of layers in a stacked arrangement such that the second part supports the eaves portion, the second part comprising a second metal, wherein the eaves portion overhangs the second part such that the second part supports the eaves portion after the first part and the second part are formed;

sintering the first metal and the second metal; and removing the second part from the article by immersing the article in an electrolyte solution and causing a current to flow in the second part, wherein the removal of the second part causes the eaves portion to overhang a space where the second part was located prior to the removal of the second part, the space being open, wherein when a long side of an upper surface of the first part is set to an X direction in the Cartesian coordinate system, a short side of the first part is set to a Y direction in the Cartesian coordinate system that crosses the X direction, and a thickness direction of the first part that crosses the X and Y directions is set to a Z direction in the Cartesian coordinate system, the eaves portion extends from the substrate portion in the X direction and the space is defined as being in the Z direction beneath the eaves portion such that a step in the Z direction is formed at a transition between the substrate portion and the eaves portion.

2. The method according to claim 1, comprising sintering the first metal after forming each of the plurality of layers of the first metal and sintering the second metal after forming each of the plurality of layers of the second metal.

3. The method according to claim 1, wherein an oxidation potential of the second metal is lower than an oxidation potential of the first metal.

4. The method according to claim 3, wherein in the removing of the second part, a potential which is equal to or higher than the oxidation potential of the second metal and lower than the oxidation potential of the first metal is applied to the article.

5. The method of claim 1, comprising:

forming a first plurality of layers, wherein each layer in the first plurality of layers includes a portion of a substrate of the first part of the article and the second part of the article;

sintering each of the first plurality of layers after forming each of the first plurality of layers;

forming a second plurality of layers over the first plurality of layers in a stacked arrangement to form a second portion of the first part of the article using the first metal, wherein the second portion of the article includes the eaves portion of the article, wherein the second part is arranged to support at least the eaves portion while the second plurality of layers are formed;

sintering each of the second plurality of layers after forming each of the second plurality of layers.

6. The method of claim 1, further comprising forming an alloy layer at an interface between the first part and the second part.

* * * * *